US006912365B2

(12) United States Patent
Ueno et al.

(10) Patent No.: US 6,912,365 B2
(45) Date of Patent: Jun. 28, 2005

(54) PROCESS CARTRIDGE, UNIT, AND ELECTROPHOTOGRAPHIC IMAGE FORMING APPARATUS

(75) Inventors: Takahito Ueno, Shizuoka (JP); Kazunari Murayama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 10/237,783

(22) Filed: Sep. 10, 2002

(65) Prior Publication Data

US 2003/0049036 A1 Mar. 13, 2003

(30) Foreign Application Priority Data

Sep. 13, 2001 (JP) ..... 2001-277781
Sep. 9, 2002 (JP) ..... 2002-262828

(51) Int. Cl.[7] ..... G03G 15/00

(52) U.S. Cl. ..... 399/25; 399/27; 399/111; 399/119

(58) Field of Search ..... 399/111, 25, 119, 399/110, 120, 27

(56) References Cited

U.S. PATENT DOCUMENTS 6,131,011 A 10/2000 Kojima et al. ..... 399/351
6,157,792 A 12/2000 Mori et al. ..... 399/24
6,266,503 B1 7/2001 Murayama et al. ..... 399/117
6,289,189 B1 9/2001 Numagami et al. ..... 399/111
6,298,217 B1 10/2001 Murayama et al. ..... 399/358
6,314,266 B1 11/2001 Murayama et al. ..... 399/353
6,385,416 B1 5/2002 Horikawa et al. ..... 399/111
6,404,995 B1 * 6/2002 Kimizuka ..... 399/111
6,404,996 B1 6/2002 Mori et al. ..... 399/24
6,442,359 B1 8/2002 Numagami et al. ..... 399/111
6,463,233 B2 10/2002 Kojima et al. ..... 399/111
6,654,567 B2 * 11/2003 Karakama et al. ..... 399/25
6,697,578 B2 * 2/2004 Watanabe et al. ..... 399/111

* cited by examiner

*Primary Examiner*—Sophia S. Chen
(74) *Attorney, Agent, or Firm*—Fitzpatrick, Cella, Harper & Scinto

(57) ABSTRACT

A process cartridge and a unit include a cover member, a memory element provided on the cover member, and a unit abutting portion. The process cartridge and the unit can be detachably mounted to the main body of an electrophotographic image forming apparatus. The main body of the electrophotographic image forming apparatus includes a main body base member and a communication device. The process cartridge and the unit are positioned to a predetermined location by the unit abutting portion abutting against the main body base member, when the process cartridge and the unit are mounted to the main body of the electrophotographic image forming apparatus. In this state, the storage element is disposed at a position facing the communication device and can communicate with it in a noncontacting manner.

22 Claims, 10 Drawing Sheets

PROCESS CARTRIDGE, UNIT, AND ELECTROPHOTOGRAPHIC IMAGE FORMING APPARATUS

BACKGROUND OF THE INVENTION

1. Field of the Invention

The present invention relates to a process cartridge, a development cartridge, a toner cartridge, and a unit that are used in an electrophotographic image forming apparatus, such as an electrophotographic copying machine or an electrophotographic printer, for example, and an electrophotographic image forming apparatus using them.

2. Description of Related Art

The term "electrophotographic image forming apparatus" refers to an apparatus which forms images on a recording medium employing an electrophotographic-image-forming process.

It may include an electrophotographic copying machine, an electrophotographic printer (an LED printer or a laser beam printer), an electrophotographic facsimile apparatus, and an electrophotographic word processor, for example.

Further, a process cartridge may incorporate therein at least one of charging means, developing means, and cleaning means as process means, and an electrophotographic photosensitive member, as a cartridge which can be detachably mounted to the main body of an electrophotographic image forming apparatus, and may incorporate therein at least developing means as process means and an electrophotographic photosensitive member as a cartridge which can be detachably mounted to the main body of the apparatus.

A development cartridge may incorporate therein developing means for developing an electrostatic latent image formed on an electrophotographic photosensitive member and a toner containing portion for containing toner as a cartridge which can be detachably mounted the main body of the electrophotographic image forming apparatus.

A toner cartridge may incorporate therein a toner containing portion that contains toner for the development of an electrostatic latent image formed on an electrophotographic photosensitive member and a carrying member for agitating and carrying the toner as a cartridge which can be detachably mounted to the main body of the electrophotographic image forming apparatus.

A unit unitizes an electrophotographic photosensitive member alone, either or both of the development means and cleaning means as process means, or fixing means alone so that they can be detachably mounted to the main body of the electrophotographic image forming apparatus separately as a unit.

The unit, the process cartridge, and the development cartridge can be attached to/detached from the main body of the apparatus by a user by himself or herself, thereby allowing the main body of the apparatus to be maintained easily.

Conventionally, a process-cartridge method has been utilized that integrally incorporates an electrophotographic photosensitive member and charging means, developing means, and cleaning means as process means, as a cartridge which can be detachably mounted to the main body of the image forming apparatus.

The cartridge method has improved the operability of the image forming apparatus, allowing users to carry out the maintenance of the process means with ease by themselves.

That is why the cartridge method is widely utilized in the main body of the image forming apparatus.

Also, cartridge configurations have been developed that incorporate process means as cartridges, based on whether each means has a long life or a short life, so that they can be used according to the life of a primary process means. For example, a development cartridge that integrates a toner container having a toner containing portion and a developing member, or a drum cartridge that integrates an electrophotographic photosensitive member and charging means and cleaning means have been utilized.

For such cartridges, such as process cartridges, a method has been conventionally adopted that facilitates the maintenance of the main body of the electrophotographic image forming apparatus or a process cartridge by embedding a memory element (storage means) in a cartridge, and registering service information in the memory element. And a method that carries out information communication between the main body of the electrophotographic image forming apparatus and a process cartridge in a non-contacting manner has been utilized.

SUMMARY OF THE INVENTION

An object of the invention is to provide a unit that can ensure the communication between communication means provided in an electrophotographic image forming apparatus and storage means, a process cartridge, a development cartridge, and an electrophotographic image forming apparatus.

An another object of the invention is to provide a unit that can maintain a constant distance between communication means provided in an electrophotographic image forming apparatus and non-contacting storage means, a process cartridge, a development cartridge, and an electrophotographic image forming apparatus.

A further object of the invention is to provide a unit that can attempt to simplify the configuration of communication means provided in an electrophotographic image forming apparatus and the configuration of non-contacting storage means, a process cartridge, a development cartridge, and an electrophotographic image forming apparatus.

And a further object of the invention is to provide a unit which can be detachably mounted to the main body of an electrophotographic image forming apparatus having a fixed main body base member and communication means provided in the main body base member, comprising;

a cover member;

a unit abutting portion which is provided on the cover member and abuts against the main body base member, for positioning the unit to the main body of the apparatus when the unit is mounted to the main body of the apparatus; and a memory element that is provided on the cover member and is disposed at a position facing the communication means, and is capable of communicating with the communication means without contacting the communication means.

A further object of the invention is to provide a process cartridge that can be detachably mounted to the main body of an electrophotographic image forming apparatus having a fixed main body base member and communication means provided on the main body base member, comprising:

an electrophotographic photosensitive member;

process means for acting on the electrophotographic photosensitive member;

a cover member;

a unit abutting portion that is provided on the cover member and abuts against the main body base member, for positioning the process cartridge to the main body of the apparatus when the process cartridge is mounted to the main body of the apparatus; and a memory element that is provided on the cover member and is disposed at a position facing the communication means, and is capable of communicating with the communication means without contacting the communication means.

A further object of the invention is to provide a development cartridge that can be detachably mounted to the main body of an electrophotographic image forming apparatus having a fixed main body base member and communication means provided on the main body base member, comprising:

a developing member for developing an electrostatic latent image formed on an electrophotographic photosensitive member;

a toner container for containing toner to be supplied to the developing member;

a cover member;

a unit abutting portion that is provided on the cover member and abuts against the main body base member, for positioning the development cartridge to the main body of the apparatus when the development cartridge is mounted to the main body of the apparatus; and a memory element that is provided on the cover member and is disposed at a position facing the communication means, and is capable of communicating with the communication means without contacting the communication means.

A further object of the invention is to provide a toner cartridge that can be detachably mounted to the main body of an electrophotographic image forming apparatus having a fixed main body base member and communication means provided on the main body base member, comprising:

a toner container that contains toner to be supplied to a developing apparatus provided in the main body of the apparatus and has a toner supplying opening that supplies the toner to the developing apparatus;

a carrying member that agitates the toner in the toner container and carries it to the toner supplying opening;

a cover member;

a unit abutting portion that is provided on the cover member and abuts against the main body base member, for positioning the toner cartridge to the main body of the apparatus when the toner cartridge is mounted to the main body of the apparatus; and a memory element that is provided on the cover member and is disposed at a position facing the communication means, and is capable of communicating with the communication means without contacting the communication means.

A further object of the invention is to provide an electrophotographic image forming apparatus to which a unit can be detachably mounted, for forming an image on a recording medium, having:

(i) a fixed main body base member, (ii) communication means provided on the main body base member for communicating with a memory element of the unit without contacting the memory element, (iii) mounting means for detachably mounting the unit that has a cover member, a unit abutting portion that is provided on the cover member and abuts against the main body base member, for positioning the unit to a main body of the electrophotographic image forming apparatus when the unit is mounted to the main body of the apparatus, and the memory element, which is provided on the cover member and is disposed at a position facing the communication means, and is capable of communicating with the communication means without contacting the communication means, and (iv) conveying means for conveying the recording medium.

A further object of the invention is to provide an electrophotographic image forming apparatus having an apparatus main body and to which a process cartridge can be detachably mounted, for forming an image on a recording medium, having:

(i) a main body base member, (ii) communication means fixedly provided on the main body base member for communicating with a memory element of the process cartridge without contacting the memory element, (iii) mounting means for detachably mounting the process cartridge that has an electrophotographic photosensitive member, process means affecting the electrophotographic photosensitive member, a cover member, a unit abutting portion that is provided integrally with the cover member and abuts against the main body base member when the unit is mounted to the apparatus main body, for determining the direction in which the unit is mounted to the main body of the apparatus, a pushed portion that is pushed by energizing means in the direction in which the unit abutting portion abuts against the main body base member, and the memory element, which is fixedly disposed at a position on the cover member that faces the communication means, and is capable of communicating with the communication means without contacting the communication means, and (iv) conveying means for conveying the recording medium.

A further object of the invention is to provide an electrophotographic image forming apparatus to which a development cartridge can be detachably mounted, for forming an image on a recording medium, comprising:

(i) a main body base member, (ii) communication means fixedly provided on the main body base member and communicating with a memory element of the development cartridge without contacting the memory element, (iii) mounting means for detachably mounting the development cartridge that has a developing member for developing an electrostatic latent image formed on an electrophotographic photosensitive member, a toner container for containing toner to be supplied to the developing member, a cover member, a unit abutting portion that is provided on the cover member and abuts against the main body base member, for positioning the development cartridge to a main body of the apparatus when the development cartridge is mounted to the main body of the electrophotographic image forming apparatus, and the memory element, which is provided on the cover member and is disposed a position facing the communication means, and is capable of communicating with the communication means without contacting the communication means, and (iv) a conveying means for conveying the recording medium.

A further object of the invention is to provide an electrophotographic image forming apparatus to which a toner cartridge is detachably mounted, for forming an image on a recording medium, comprising:

(i) a main body base member, (ii) communication means fixedly provided on the main body base member for communicating with a memory element of the toner cartridge without contacting the memory element, (iii) mounting means for detachably mounting the toner cartridge that has a toner container that contains toner to be supplied to a developing apparatus provided in a main body of the apparatus and has a toner supplying opening for supplying the toner to the developing apparatus, a carrying member that agitates the toner in the toner container and carries the toner to the toner supplying opening, a cover member, a unit abutting portion that is provided on the cover member and abuts against the main body base member, for positioning the toner cartridge to the main body of the electrophotographic image forming apparatus when the toner cartridge is mounted to the main body of the apparatus, and the memory element, which is provided on the cover member and disposed at a position facing the communication means, and is capable of communicating with the communication means without contacting the communication means, and (iv) conveying means for conveying the recording medium.

BRIEF DESCRIPTION OF THE DRAWINGS

The drawings relate to the embodiments of the present invention.

DESCRIPTION OF THE PREFERRED EMBODIMENTS

In the following description, a color electrophotographic image forming apparatus according to the invention will be described in conjunction with drawings. In the description below, the longitudinal direction refers to a direction that is orthogonal to the direction of conveying a recording medium and is the same as the direction of the axis of an electrophotographic photosensitive member (hereafter a photosensitive drum 2). And "right" and "left" refer to the right and left directions in FIG. 1 that are the same as the conveying directions of the recording medium 52. "Above" and "below" refer to positions above and below the cartridge after the cartridge is mounted to the electrophotographic image forming apparatus. The term "back side" refers to the leading side of the process cartridge when the process cartridge is mounted to the main body of the apparatus in parallel with the photosensitive drum 2. And the term "front side" refers to the opposite side of the process cartridge from the back side.

(Description of the General Structure of an Image Forming Apparatus)

First, the general configuration of a color electrophotographic image forming apparatus will be generally described with reference to FIG. 1.

Figure 1:
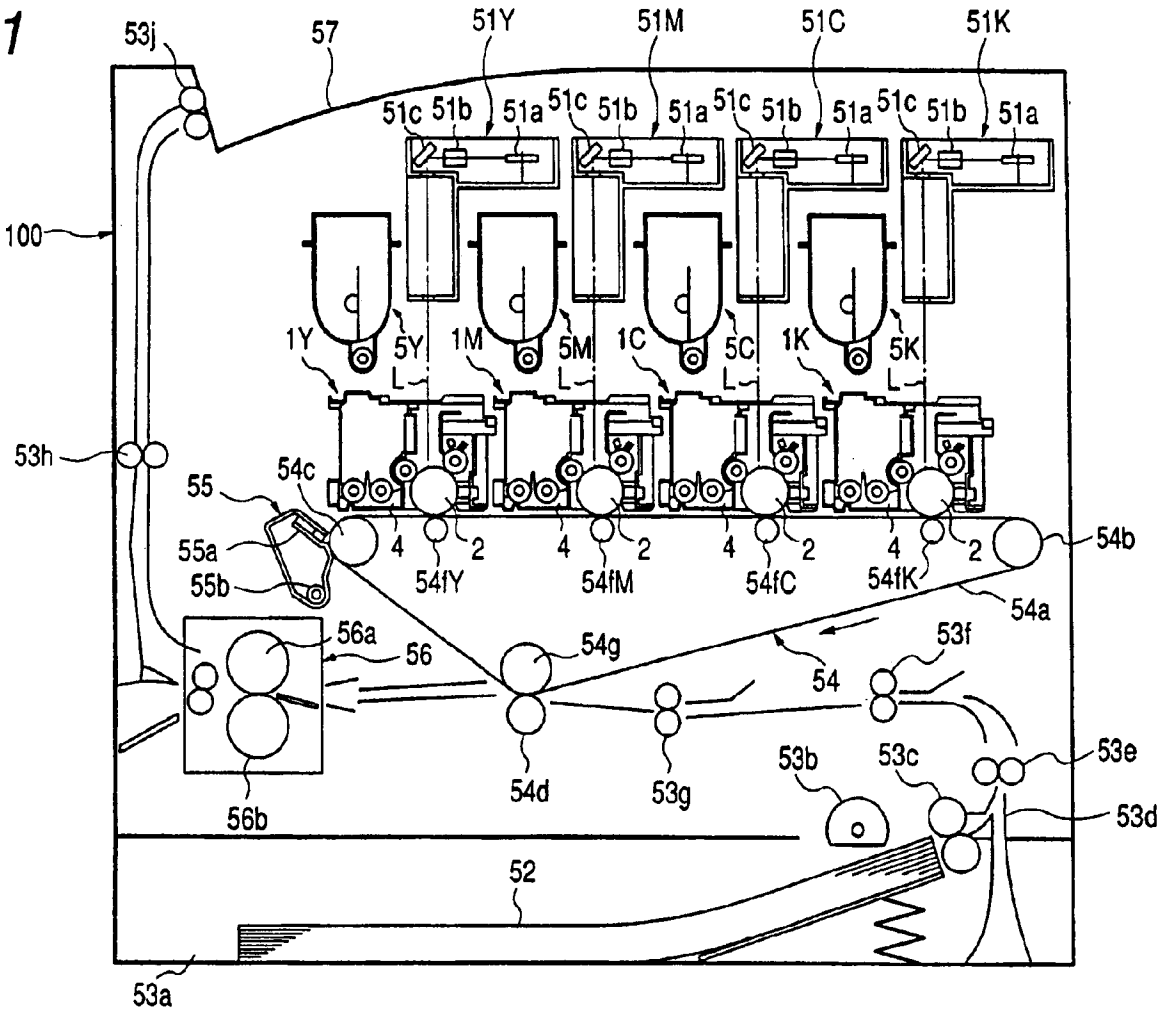
FIG. 1 is a longitudinal sectional view of the main body of an image forming apparatus.

FIG. 1 illustrates the general configuration of a color laser beam printer that is an embodiment of the color toner image forming apparatus.

In the image forming section of the color laser beam printer, four process cartridges having a photosensitive drum 2 as an image bearing body, 1Y, 1M, 1C, and 1K (yellow, magenta, cyan, and black), and above the process cartridges 1Y, 1M, 1C, and 1K, exposure means corresponding to each color, 51Y, 51M, 51C, and 51K (laser beam optical scanning system) are respectively positioned in parallel.

Below the image forming section, feeding means for feeding a recording medium 52, an intermediate transferring belt 54*a* that transfers a toner image formed on the photosensitive drum 2, and a secondary transferring roller 54*d* that transfers a toner image on the intermediate transferring belt 54*a* onto the recording medium 52 are arranged.

In addition, fixing means for fixing the recording medium 52 with a toner image transferred thereon, and discharge means for discharging the recording medium 52 out of the apparatus and stacking it are employed.

The recording medium 52 includes paper, an OHP sheet, or cloth, for example.

The image forming apparatus of the embodiment is an apparatus that uses a cleanerless system: transfer residual toner remaining on the photosensitive drum 2 is taken into the developing means, and thus, a dedicated cleaner for collecting and storing transfer residual toner is not provided in the process cartridge.

Now, the configuration of each part of the image forming apparatus will be sequentially described in detail.

(Sheet Feeding Section)

A sheet feeding section is for feeding a recording medium 52 to the image forming section, consisting mainly of a feeding cassette 53*a* in which a plurality of recording media are contained by being stacked therein, a feeding roller 53*b*, a retard roller 53*c* for preventing double feeding, a feeding guide 53*d*, and a registration roller 53*g*.

The feeder roller 53*b* is driven to rotate in accordance with image forming operations and feeds the recording medium 52 in the feeding cassette 53*a* one by one, separately. The recording medium 52 is guided by the feeding guide 53*d* to be conveyed to the registration roller 53*g* via the conveying rollers 53*e* and 53*f*.

Immediately after the recording medium 52 is conveyed, the registration roller 53*g* stops rotating, and the skew-feeding of the recording medium 52 is prevented by the medium hitting (contacting) against the nip portion of the registration roller 53*g*.

During image forming operations, the registration roller 53*g* performs a non-rotating operation of keeping the recording medium 52 in a stationary state, and a rotating operation of feeding the recording medium 52 to the intermediate transferring belt 54*a* in a predetermined sequence, positioning a toner image and the recording medium 52 for the following transferring process.

(Process Cartridge)

In the process cartridges 1Y, 1M, 1C, and 1K, charging means and developing means are positioned around the photosensitive drums 2, which functions as an image bearing body, and the charging means and the developing means are integrally incorporated into the process cartridges. And these process cartridges 1Y, 1M, 1C, and 1K can be easily mounted to/removed from the main body of the apparatus 100 by a user and replaced upon the photosensitive drum 2 reaching the end of its life.

In the embodiment, the rotations of the photosensitive drum 2 are counted so that one can be informed that the process cartridges 1Y, 1M, 1C, or 1K have worn out when a predetermined count number is exceeded, for example.

The photosensitive drum 2 of the embodiment is a negatively-charged organic photosensitive member and has a photosensitive member layer normally used on top of an aluminum drum base having a diameter of 30 mm, a charge injecting layer being provided on the outermost layer. And the drum 2 is rotated at a predetermined process speed, approximately 17 mm/sec for the embodiment.

The charge injecting layer uses a coated layer of material with SnO2 ultra-fine particles, for example, as conductive ultra-fine particles dispersed over a binder made of an insulative resin.

Figure 4:
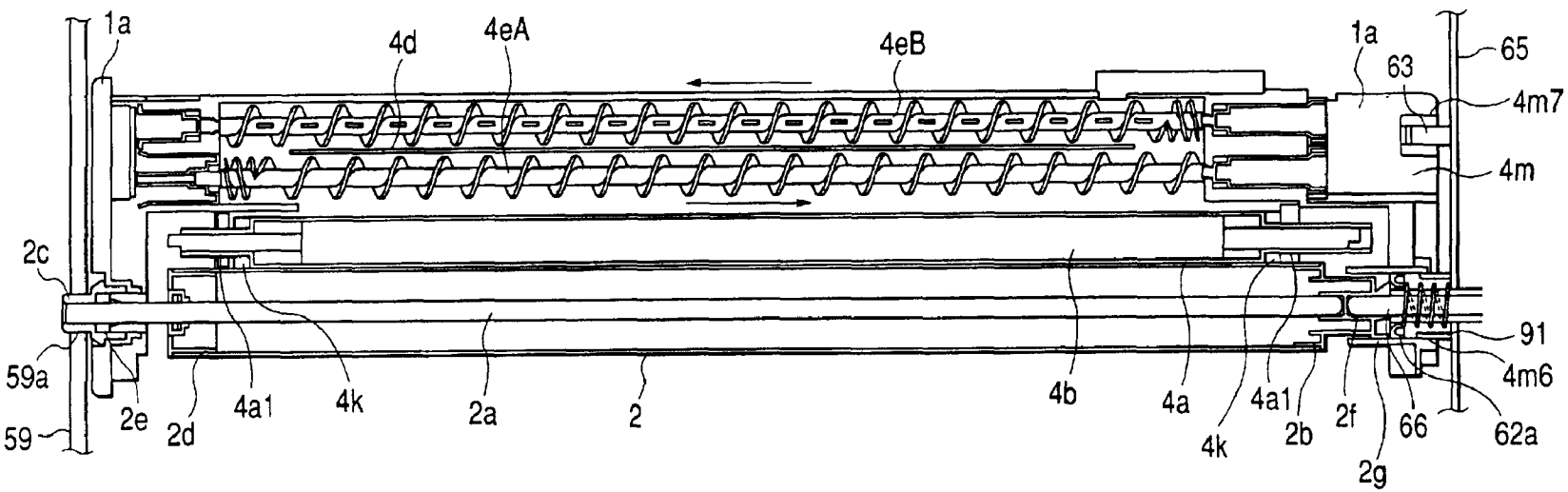
FIG. 4 is a sectional view taken at the broken line 4—4 in FIG. 2.

As shown in FIG. 4, a drum flange 2*b* is fixed at the end of the back side of the photosensitive drum 2, and a non-driven flange 2*d* is fixed at the end of the front side. A drum shaft 2*a* passes through the center of the drum flange 2*b* and the non-driven flange 2*d*, so the drum shaft 2*a*, the drum flange 2*b*, and the non-driven flange 2*d* are rotated together.

Namely, the photosensitive drum 2 is rotated about the axis of the drum shaft 2*a*.

The front side end of the drum shaft 2*a* is rotatably supported by a bearing 2*e*, and the bearing 2*e* is fixed to a bearing case 2*c*. And the bearing case 2*c* is fixed to a frame 1*a* of the process cartridge 1.

(Charging Means)

The charging means employs a contact charging method. In the embodiment a charging roller 3*a* is used as a charging member.

Figure 2:
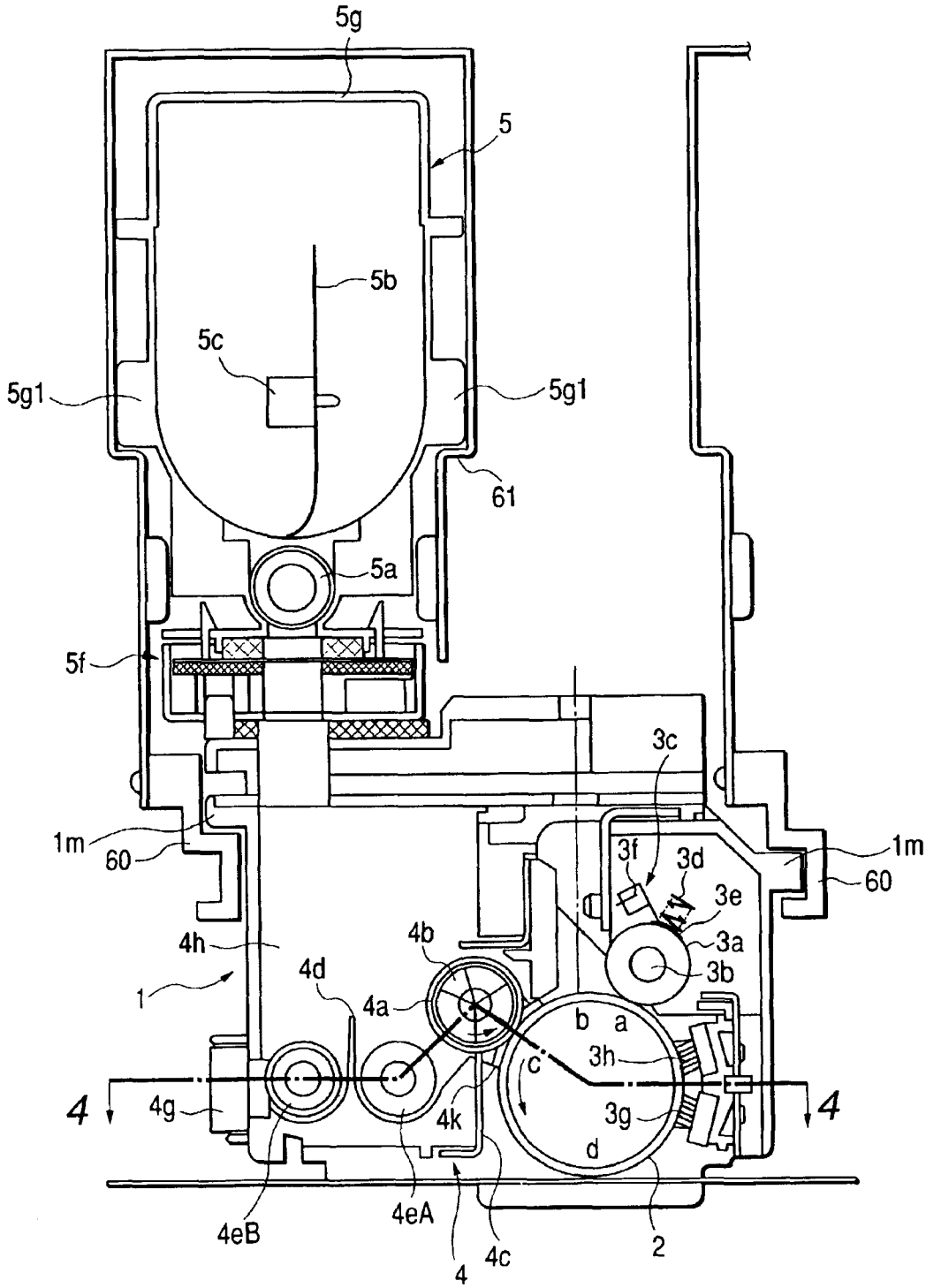
FIG. 2 is a longitudinal sectional view of a process cartridge and a toner replenishment container.

As shown in FIG. 2, both ends of center wire 3*b* are each rotatably supported by bearing members (not shown), and the charging roller 3*a* is energized (biased) in the direction of the photosensitive drum by a push spring 3*d* to be pressed against the surface of the photosensitive drum 2 under a certain pressure, rotating in accordance with the rotation of the photosensitive drum 2. Reference characters 3*c* denote a charging roller cleaning member comprising a cleaning film 3*e* having flexibility in the embodiment. The cleaning film 3*e* is positioned in parallel with the longitudinal direction of the charging roller 3*a* and has its one end fixed by a supporting member 3*f* that performs a certain amount of reciprocation in the longitudinal direction, such that the film 3*e* forms a contact nip with the charging roller 3*a* on a plane in the proximity of a free end side of the film 3*e*. The supporting member 3*f* is reciprocated a certain amount in the longitudinal direction by driving means (not shown), and the surface of the charging roller 3*a* is fractionized by the cleaning film 3*e*. This removes accretion (fine powder toner, external additives or the like) from the charging roller surface.

The image forming apparatus of the embodiment adopts the cleanerless system.

Next, the cleanerless system will be described.

(Cleanerless System)

To summarize the cleanerless system for the image forming apparatus of the embodiment: transfer residual toner on the photosensitive drum 2 after transferring is carried to the developing portion c through the charging portion a and the exposure portion b with the rotation of the photosensitive drum 2, and cleaned (collected) by the developing apparatus 4 simultaneously with development.

The exposure process is carried out over transfer residual toner since transfer residual toner on the photosensitive drum 2 surface passes to the exposure portion b. But, a significant effect is not caused because the amount of transfer residual toner is small.

However, transfer residual toner includes residual toner of a normal polarity, of a reverse polarity (reverse toner), and of a small charging amount, and the charging roller 3*a* would be inadmissibly contaminated by toner to cause charging failure because of reverse toner or toner with a small amount of charge being adhered to the charging roller 3*a* in passing the charging portion a of FIG. 2.

And to effectively carry out the cleaning of the transfer residual toner on the photosensitive drum surface by the developing device 4 simultaneously with development, it is required that the charging polarity of the transfer residual toner on the photosensitive drum to be carried to the developing portion c of FIG. 2 is the normal polarity, and that its charge amount is sufficient for the developing apparatus 4 to develop an electrostatic latent image on the photosensitive drum 2. Reverse toner and toner of an inappropriate charge amount cannot be removed and collected from the photosensitive drum 2 by the developing apparatus 4, resulting in inferior images.

Also, as users needs have diversified in recent years, a sequential high-printing-rate printing operation of images, such as photographic images, creates a large amount of transfer residual toner at one time, thereby exacerbating the problems mentioned above.

Therefore, in the embodiment, transfer residual toner (residual developer image) uniformizing means 3*g* for uniformizing transfer residual toner on the photosensitive drum 2 is provided at a position downstream from the transferring portion d of FIG. 2 in the moving direction of the periphery of the photosensitive drum 2. And at a point that is downstream from the transfer residual toner uniform uniformizing means 3*g* in the moving direction of the periphery of the photosensitive drum 2 and is upstream from the charging portion a of FIG. 2 in the moving direction of the periphery of the photosensitive drum 2, toner (developer) charging control means 3*h* for matching the charge polarity of the transfer residual toner to a negative polarity, i.e., normal polarity, is provided.

By providing the transfer residual toner uniformizing means 3*g*, transfer residual toner, which forms patterns on the photosensitive drum, to be carried from the transferring portion d of FIG. 2 to the toner charging control means 3*h* is distributed and dispersed over the photosensitive drum surface in a non-pattern, even if the amount of transfer residual toner on the photosensitive drum is large. Therefore, toner will not concentrate on a portion of the toner charging control means 3*h*, and the toner charging control means 3*h* can always perform sufficient normal polarity charging for the entire transfer residual toner, effectively preventing transfer residual toner from adhering to the charging roller 3*a*. The occurrence of a ghost image corresponding to the transfer residual toner image pattern can be also prevented.

In the embodiment, the transfer residual toner uniformizing means 3*g* and the toner charging control means 3*h* are brush-like members with an appropriate conductivity, their brush portions being positioned in contact with the photosensitive drum surface.

These means are moved (reciprocated) in the longitudinal direction of the photosensitive drum 2 by a driving source (not shown). This can prevent the transfer residual toner uniformizing means 3*g* and the toner charging control means 3*h* from staying at the same position on the photosensitive drum. For example, even if there exists an over-charged portion or an under-charged portion of the transfer residual toner due to uneven resistance of the toner charging control means 3*h*, it would not always occur on the same position on the photosensitive drum surface. Accordingly, the occurrence of fusion on the photosensitive drum due to local overcharging of the transfer residual toner, and adhesion of the transfer residual toner to the charging roller 3*a* due to inadequacy of charging can be prevented or alleviated.

(Exposure Means)

In the embodiment, exposure to the photosensitive drum 2 is carried out using laser exposure means. That is, when an image signal is sent from the main body of the apparatus 100, laser L that has been modulated correspondingly scans the uniformly charged surface of the photosensitive drum 2, exposing the surface of the photosensitive drum 2 to the laser light L. An electrostatic latent image corresponding to image information is then selectively formed on the photosensitive drum 2 surface.

Laser exposure means consists of solid laser elements (not shown), a polygon mirror 51*a*, an imaging lens 51*b*, and a reflecting mirror 51*c* and so on. Based on an inputted image signal, solid laser elements are controlled to emit light (by being turned on and off) with a predetermined timing by an emission signal generator (not shown). Laser L radiating from the solid laser elements is converted to an approximately parallel luminous flux by a collimator lens system (not shown) and is caused to scan by a polygon mirror 51*a* rotating at a high speed. And it is imaged onto the photosensitive drum 2 in a spot via the imaging lens 51*b* and the reflecting mirror 51*c*.

Thus, exposure in a main scanning direction with laser scanning and exposure in a sub-scanning direction with the rotation of the photosensitive drum 2 are carried out with respect to the surface of the photosensitive drum 2, resulting in an exposure distribution corresponding to an image signal.

That is, the radiating of laser light L and the stopping of the radiating of laser L forms a light portion potential with a lower surface potential on the photosensitive drum 2 and a dark portion potential not having the lower surface potential on the photosensitive drum 2. And the contrast between the light portion potential and the dark portion potential forms an electrostatic latent image corresponding to image information.

(Developing Means)

The developing apparatus 4 as developing means is a two-component contact developing apparatus (two-component magnetic brush developing apparatus), and, as shown in FIG. 2, holds developer consisting of carrier and toner on a developing sleeve 4*a*, functioning as a developer bearer, that contains a magnet roller 4*b* therein. A regulation blade 4*c* is provided on the developing sleeve 4*a* with a certain gap therebetween, forming a thin layer of developer on the developing sleeve 4*a* as the developing sleeve 4*a* rotates in the direction indicated by the arrow.

As shown in FIG. 4, the developing sleeve 4*a* is positioned at a certain gap from the photosensitive drum 2 by rotatably fitting spacers 4*k* into journal portions 4*a*1 with a smaller diameter at the both ends of the sleeve. And during development, developer formed on the developing sleeve 4*a* can be developed in contact with the photosensitive drum 2. Here, the spacer 4*k* is a cylinder that has a larger outer diameter than that of the developing sleeve 4*a* so that a space for developing is created therebetween. The peripheral surface of the developing sleeve 4*a* moves in a direction counter to the moving direction of the periphery of the photosensitive drum 2, and thus the sleeve 4*a* is rotated in the clockwise direction indicated by the arrow at a certain peripheral velocity.

In the embodiment, negatively charged toner having an average particle diameter of 6 $\mu$m is used for toner, and a magnetic carrier having saturation magnetization of 205 emu/cm$^3$ and an average particle diameter of 35 $\mu$m is used for the magnetic carrier. And a mixture of toner and carrier at a weight ratio of 6:94 is employed as developer.

A developer containing portion 4*h* in which developer circulates is partitioned into two by a longitudinal dividing wall 4*d* except for both ends. And agitating screws 4*e*A and 4*e*B are positioned on the opposite sides of the wall 4*d*.

As shown in FIG. 4, toner replenished by a toner replenishment container 5 falls into the back side of the agitating screw 4*e*B and is agitated while being sent toward the front side of the developing apparatus 4 in the longitudinal direction thereof, passing through the portion at the front side end of the developing apparatus without the dividing wall 4*d*. The toner is then sent to the back side of the developing apparatus in the longitudinal direction thereof by the agitating screw 4*e*A and passes through the portion at the back side without the dividing wall 4*d* to be agitated by the agitating screw 4*e*B as it was when it was sent to the front side of the developing apparatus, thus repeating circulation.

The developing process which visualizes an electrostatic latent image formed on the photosensitive drum 2 employing the two-component magnetic brush method of the developing apparatus 4 and the circulating system of developer will be now described.

As the developing sleeve 4*a* rotates, developer in the developer containing portion is pumped by a pumping pole of the magnet roller 4*b* onto the surface of the developing sleeve 4*a* and carried.

The layer thickness of the developer is regulated by the regulation blade 4*c* positioned vertically with respect to the developing sleeve 4*a*, and a thin layer of developer is formed on the developing sleeve 4*a*. When the thin layer of developer is carried to a developing pole corresponding to the developing portion c of FIG. 2, a spike is formed by magnetic force. An electrostatic latent image on the photosensitive drum 2 surface is developed as a toner image by the toner in the developer formed in this spike shape. In this instance, the electrostatic latent image is reversely developed.

After passing the developing portion c of FIG. 2, the thin layer of developer on the developing sleeve 4*a* then enters the developer containing portion as the developing sleeve 4*a* rotates, leaves the developing sleeve 4*a* due to the repulsive magnetic field of a carrying pole to be pulled back to a developer pool in the developer containing portion.

Direct current (DC) voltage and alternating current (AC) voltage are applied to the developing sleeve 4*a* from a power supply (not shown). In the embodiment, a DC voltage of −500 V and an AC voltage having a peak-to-peak voltage of 1500 V at a frequency of 200 Hz are applied to develop only exposed portions on the photosensitive drum 2.

In general, with the two-component developing method, the application of AC voltage improves the efficiency of development and image quality, but in turn fog can occur easily. Accordingly, a potential difference is normally provided between the DC voltage applied to the developing sleeve 4*a* and the surface potential of the photosensitive drum 2 so that the prevention of fog can be realized. More specifically, a bias voltage of the potential between the potential of the exposure portion of the photosensitive drum 2 and the potential of non-exposed portion is applied.

As toner is consumed for development, the toner concentration of developer becomes lower.

In the embodiment, a sensor 4*g* for detecting toner concentration is disposed at a position close to the outer periphery of the agitating screw 4*e*B. When the sensor 4*g* detects that the toner concentration of the developer has fallen below a predetermined concentration level, an instruction is issued for replenishing toner from the toner replenishment container 5 to the developing device 4. This toner replenishment operation maintains and controls toner concentration of the developer at a predetermined level all the time.

(Toner Replenishment Container)

Toner replenishment containers 5Y, 5M, 5C, and 5K are positioned in parallel above the process cartridges 1Y, 1M, 1C, and 1K, and are mounted from the front side of the main body of the apparatus 100.

Figure 5:
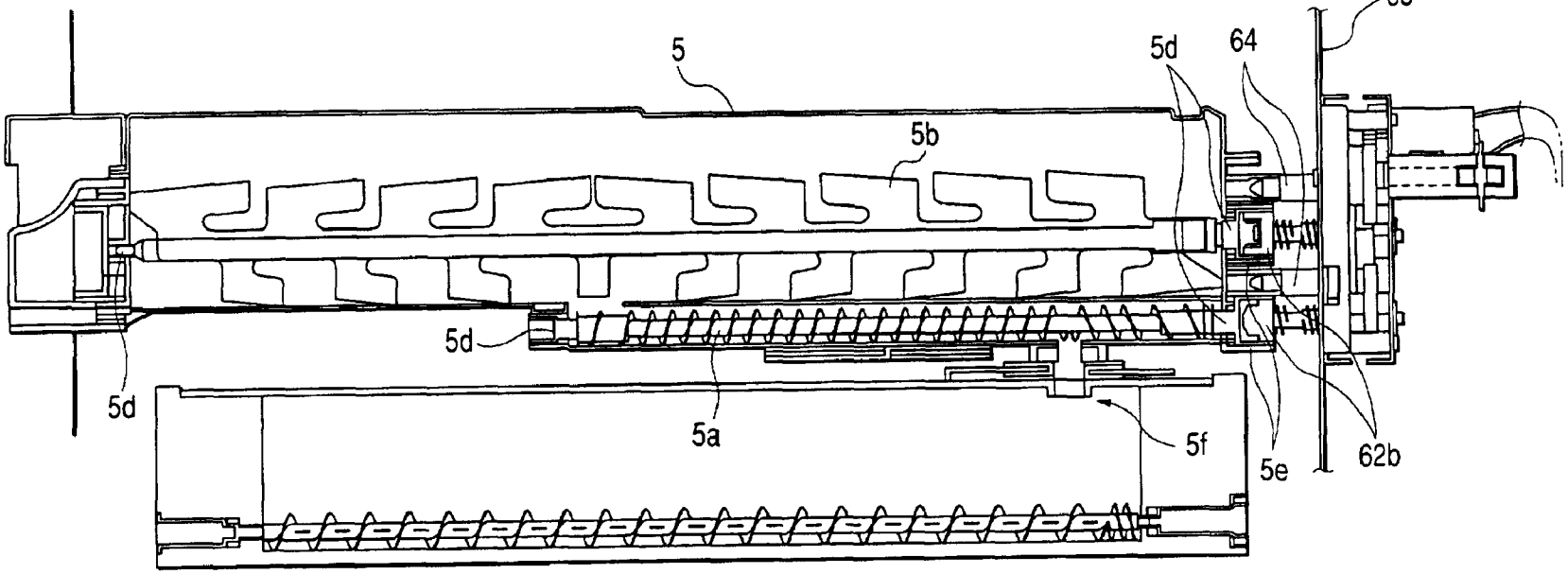
FIG. 5 is a longitudinal sectional view of the toner replenishment container in the longitudinal direction.

As shown in FIG. 2, an agitating plate 5*b* fixed to an agitating axis 5*c* and a screw 5*a* are positioned inside the toner replenishment container 5, a discharge opening 5*f* for discharging toner being formed at the bottom of the container. As shown in FIG. 5, the screw 5*a* and the agitating axis 5*c* arc rotatably supported at their both ends by bearings 5*d*, and drive couplings (concave) 5*e* are positioned at one end. The drive couplings (concave) 5*e* receive a driving transmission force from drive couplings (convex) 62*b* and are rotated. The exterior of the screw 5*a* has a spiral ribbed shape, and the twisting direction of the spiral is reversed at the discharge opening 5*f*. The rotation of the drive coupling (convex) 62*b* causes the screw 5*a* to rotate in a predetermined rotational direction. And toner is carried toward the discharge opening 5*f* and falls freely from the opening of the discharge opening 5*f* so that the toner is replenished to the process cartridge 1. The tip of the agitating plate 5*b* in the direction of its turning radius is inclined, and when it contacts the wall of the toner replenishment container 5 in a sliding manner, it abuts against the wall at a certain angle. Specifically, the tip of the agitating plate 5*b* is twisted to form a spiral shape. The tip of the agitating plate 5*b* being twisted and inclined causes the generation of a conveying force in the axis direction, carrying toner in the longitudinal direction.

The toner replenishment container 5 of the embodiment may supply toner not only with the two-component developing method but with a process cartridge or a development cartridge using the one-component developing method. It should be noted that the powder contained in the toner replenishment container is not limited to toner but may be what is called two-component developer that is a mixture of toner and magnetic carrier.

(Transferring Means)

The intermediate transferring unit 54 as transferring means secondarily transfers a plurality of toner images, which have been primarily transferred from the photosensitive drum 2 and overlapped in sequence, onto the recording medium 52 all at once.

As shown in FIG. 1, the intermediate transferring unit 54 comprises the intermediate transferring belt 54*a*, which runs in the clockwise direction indicated by the arrow at a peripheral velocity approximately the same as the outer peripheral velocity of the photosensitive drum 2. The intermediate transferring belt 54*a* is an endless belt having a peripheral length of about 940 mm, and is supported by three rollers: a drive roller 54*b*, a secondary transfer opposed roller 54*g*, and a driven roller 54*c*.

Inside the intermediate transferring belt 54*a*, each of transfer charging rollers 54*f*Y, 54*f*M, 54*f*C, and 54*f*K are rotatably disposed at positions opposed to each photosensitive drum 2, and are pressed toward the center of the photosensitive drum 2.

Transfer charging rollers 54*f*Y, 54*f*M, 54*f*C, and 54*f*K are supplied with voltage from a high-voltage power supply (not shown), and carry out charging with reverse polarity of the toner from the back side of the intermediate transferring belt 54*a* and primarily transfer toner images on the photosensitive drum 2 onto the upper surface of the intermediate transferring belt 54*a* in sequence.

At the secondary transferring portion, a secondary transferring roller 54*d* as a transferring member is pressed against the intermediate transferring belt 54*a* at a position opposed to the secondary transfer opposed roller 54*g*. The secondary transferring roller 54*d* can rock up and down and rotate in the figure. At the same time, a bias is applied to the intermediate transferring belt 54*a*, and thus toner images on the intermediate transferring belt 54*a* are transferred to the recording medium 52.

The intermediate transferring belt 54*a* and the secondary transferring roller 54*d* are individually driven. When the recording medium 52 enters the secondary transferring portion, a predetermined bias is applied to the secondary transferring roller 54*d* and a toner image on the intermediate transferring belt 54*a* is secondarily transferred to the recording medium 52.

Concurrently with the transfer process, the recording medium 52 between the belt 54*a* and the roller 54*d* is conveyed in the left direction in the figure at a predetermined speed toward the next process, which is a fixing process performed by a fixing device 56.

At a predetermined position on the intermediate transferring belt 54*a*, which is a position at the far downstream end of the portion of the apparatus that performs the transfer process, a cleaning unit 55 that can come into contact with/move away from the surface of the intermediate transferring belt 54*a* is provided, removing transfer residual toner remaining after the secondary transfer.

Inside the cleaning unit 55, a cleaning blade 55*a* for removing transfer residual toner is positioned. The cleaning unit 55 is mounted about a rotational center (not shown) such that it can rock, and the cleaning blade 55*a* is pressed against the intermediate transferring belt 54*a* in the direction in which it engages with the belt 54*a*.

Transfer residual toner taken into the cleaning unit 55 is conveyed to a removed toner tank (not shown) by a conveying screw 55*b* and stored therein.

The intermediate transferring belt 54*a* can be made of polyimide resin. The material is not limited to polyimide resin: plastics such as polycarbonate resin, polyethylene terephthalate resin, polyvinyl fluoride resin, polyethylene naphthalate resin, polyether ether ketone resin, polyethersulphone resin, polyurethane resin, and fluororubber and silicone rubber can be favorably used.

(Fixing Section)

A toner image formed on the photosensitive drum 2 by the development means is transferred onto the recording medium 52 through the intermediate transferring belt 54*a*. And the fixing device 56 fixes the toner image transferred to the recording medium 52 by means of heat.

As shown in FIG. 1, the fixing device 56 comprises a fixing roller 56*a* for applying heat to the recording medium 52 and a pressure roller 56*b* for pressing the recording medium 52 against the fixing roller 56*a*, each roller being a hollow roller. Each roller has a heater (not shown) therein. And the rollers are rotated so that the recording medium 52 is conveyed simultaneously.

That is, the recording medium 52 bearing a toner image is conveyed by the fixing roller 56*a* and the pressure roller 56*b*, and at the same time the toner image is fixed to the recording medium 52 by applying heat and pressure. The fixed recording medium 52 is discharged by discharge rollers 53*h* and 53*j* to be stacked in a tray 57 on the main body of the apparatus 100.

(Mounting a Process Cartridge and a Toner Replenishment Container)

Figure 3:
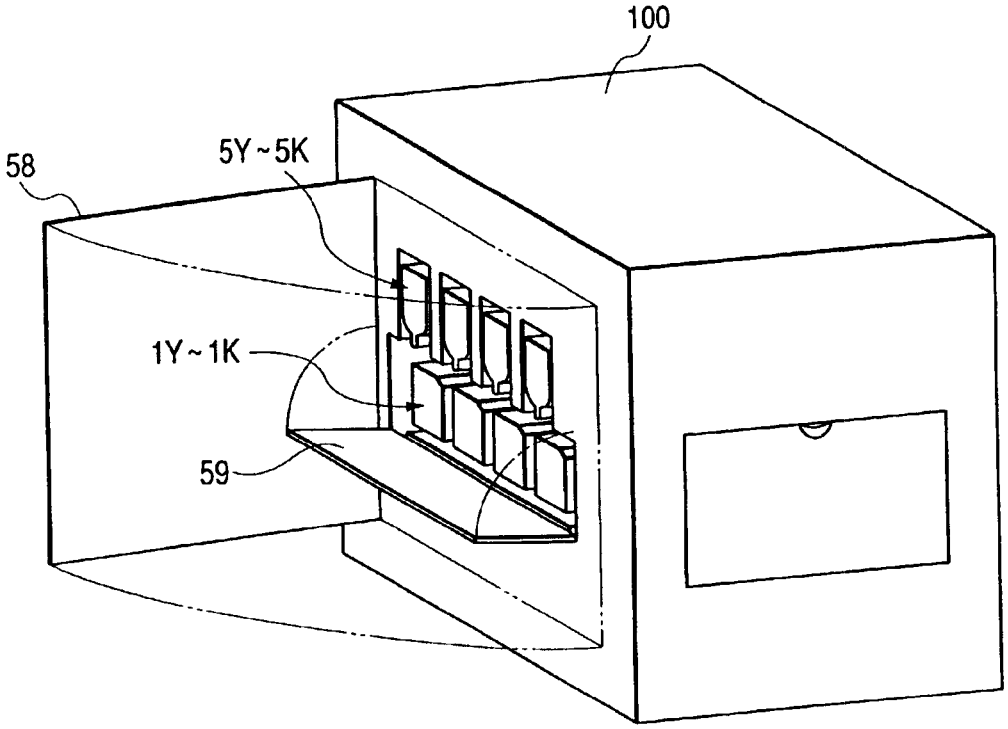
FIG. 3 is a perspective view showing the general structure of the image forming apparatus.

Next, the mounting procedure of a process cartridge and a toner replenishment container will be described with reference to FIGS. 2, 3, 4, and 6. As shown in FIG. 3, a openable and closable front door 58 is positioned at the front of the main body of the apparatus 100: pulling the font door 58 open, exposes an opening for inserting the process cartridges 1Y, 1M, 1C, and 1K, which are represented by reference numeral 1 and the toner replenishment containers 5Y, 5M, 5C, and 5K, which are represented by reference character 5.

A centering plate 59, which is turnably supported, is positioned at the opening for inserting the process cartridge 1, and a process cartridge is inserted or pulled out after the centering plate 59 is opened.

As shown in FIG. 2, a guide rail 60 for guiding the attachment of the process cartridge 1 and a guide rail 61 for guiding the attachment of the toner replenishment container 5 are fixed inside the main body of the apparatus 100. At the both ends of the upper surface of the process cartridge 1, guiding portions 1*m* in the longitudinal direction are provided. The toner replenishment container 5 is provided with guiding portions 5*g*1 in the longitudinal direction at the right and left of the container proper 5*g*.

The direction in which the process cartridge 1 and the toner replenishment container 5 are mounted is parallel to the direction of the photosensitive drum 2 axis, and the guide rails 60 and 61 also disposed in a similar direction. The process cartridge 1 and the toner replenishment container 5 are inserted from the front of the main body of the apparatus 100 and slid along the guide rails 60 and 61 toward the back side, with the guide rails 60 and 61, and guiding portions 1*m* and 5*g*1 engaged with each other.

When the process cartridge is inserted as far as it goes, centering axis 66 of the main body of the apparatus 100 is inserted into the center hole 2*f* of the drum flange 2*b* as shown in FIG. 4, which positions the rotational center position of the back side of the photosensitive drum 2 to the main body of the apparatus 100. At the same time, a drive transmitting portion 2*g* formed on the drum flange 2*b* and a drive coupling (concave) 62*a* are connected to allow the photosensitive drum 2 to rotate. The drive transmitting portion 2*g* forms the shape of a twisted triangular pole, and the drive coupling (concave) 62*a* forms a hole to receive the twisted triangular pole. The drive coupling 62*a* moves forward to fit the drive transmitting portion 2*g*. The application of a driving force from the main body of the apparatus 100 to the drive coupling (concave) 62*a* transmits the driving force and also generates a force that draws the photosensitive drum 2 backward.

Moreover, a supporting pin 63 as a main body supporting member for positioning the process cartridge 1 is positioned on a back side plate 65 fixed to the main body of the apparatus 100, and the supporting pin 63 is inserted into the long hole 4*m*7 in the frame 1*a* of the process cartridge 1, and a hole 4*m*6 as a cylindrical member in the driving part side cover 4*m* as a part of the frame 1 a receives a cylindrical portion 91*a* of a frame supporting member 91 supporting the cartridge frame of the process cartridge 1 so that the radial direction is regulated.

A turnable centering plate 59 is positioned at the front side of the main body of the apparatus 100, and the bearing case 2*c* fits into the hole 59*a* in the centering plate 59 and therefore, the bearing case 2*c* of the process cartridge 1 is supported and fixed to the centering plate 59. The completion of this sequence of insertion operations positions the photosensitive drum 2 and the process cartridge 1 to the main body of the apparatus 100.

Meanwhile, as shown in FIG. 5, the toner replenishment container 5 is fixed to a supporting pin 64 protruding from the back side plate 65 when the toner replenishment container 5 is inserted as far as it goes. At the same time, the drive coupling (concave) 5*e* and the drive coupling (convex) 62*b* are connected, allowing the screw 5*a* and the agitating axis 5*c* to rotate.

(Embodiments)

Figure 6:
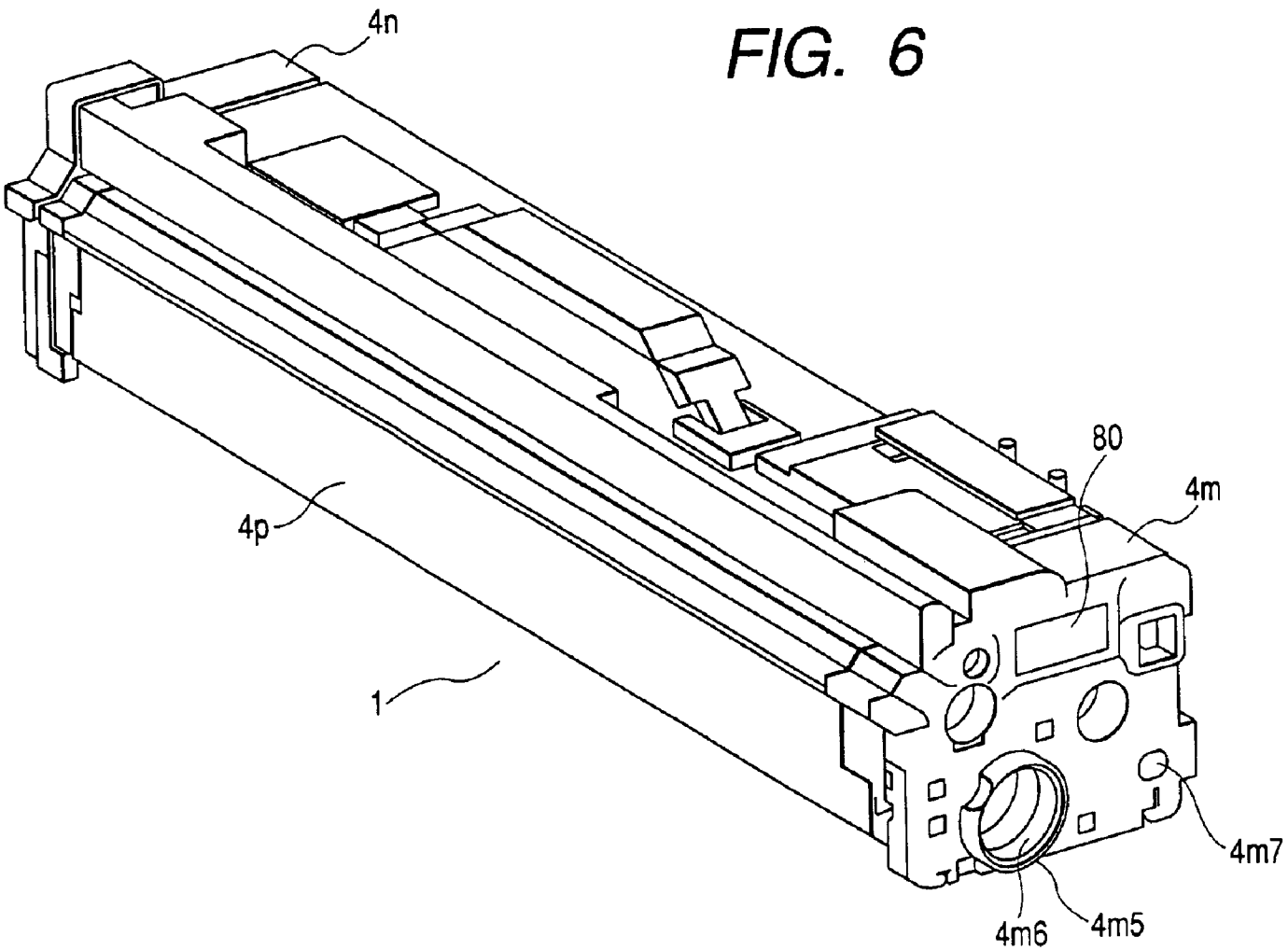
FIG. 6 is a perspective view of the process cartridge.
Figure 7:
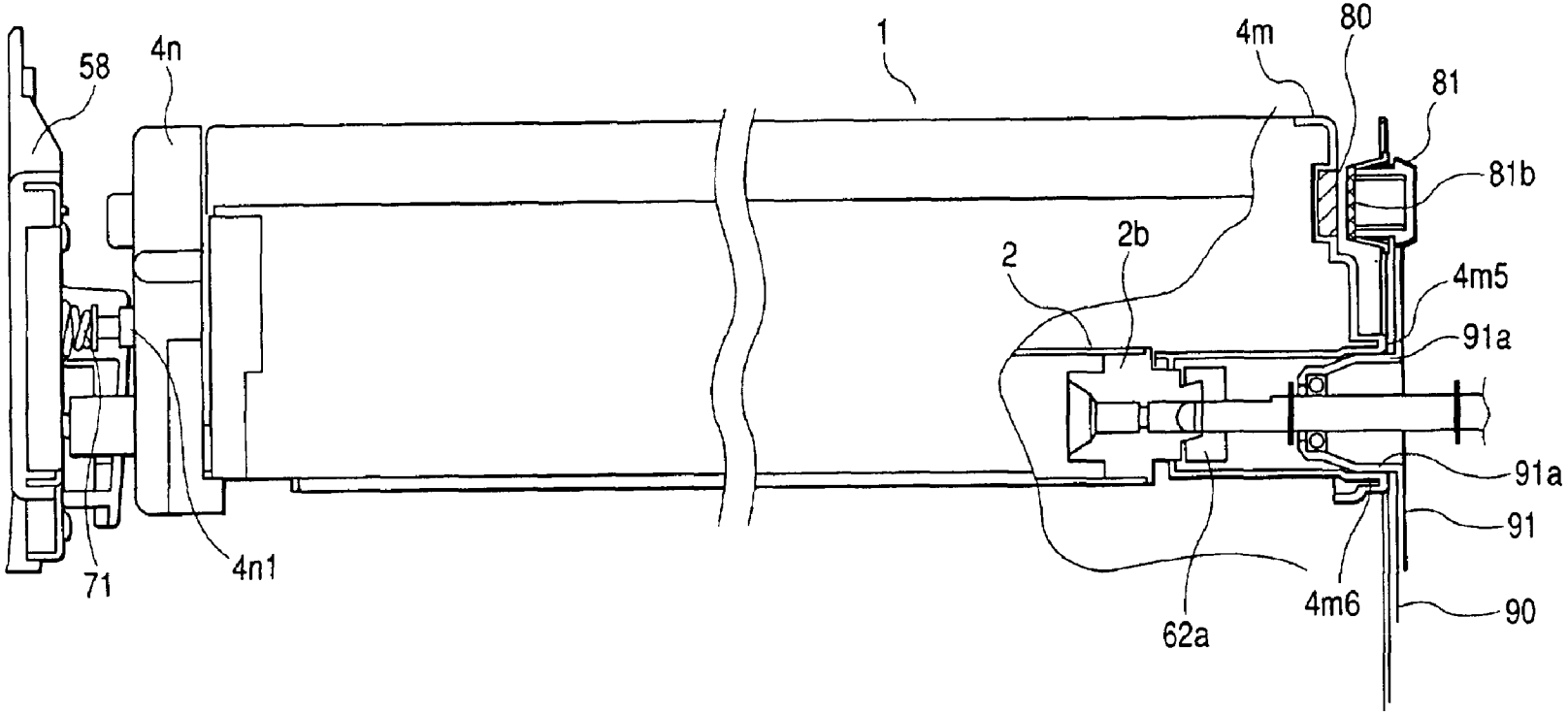
FIG. 7 is a partial sectional view showing the process cartridge being mounted.
Figure 8:
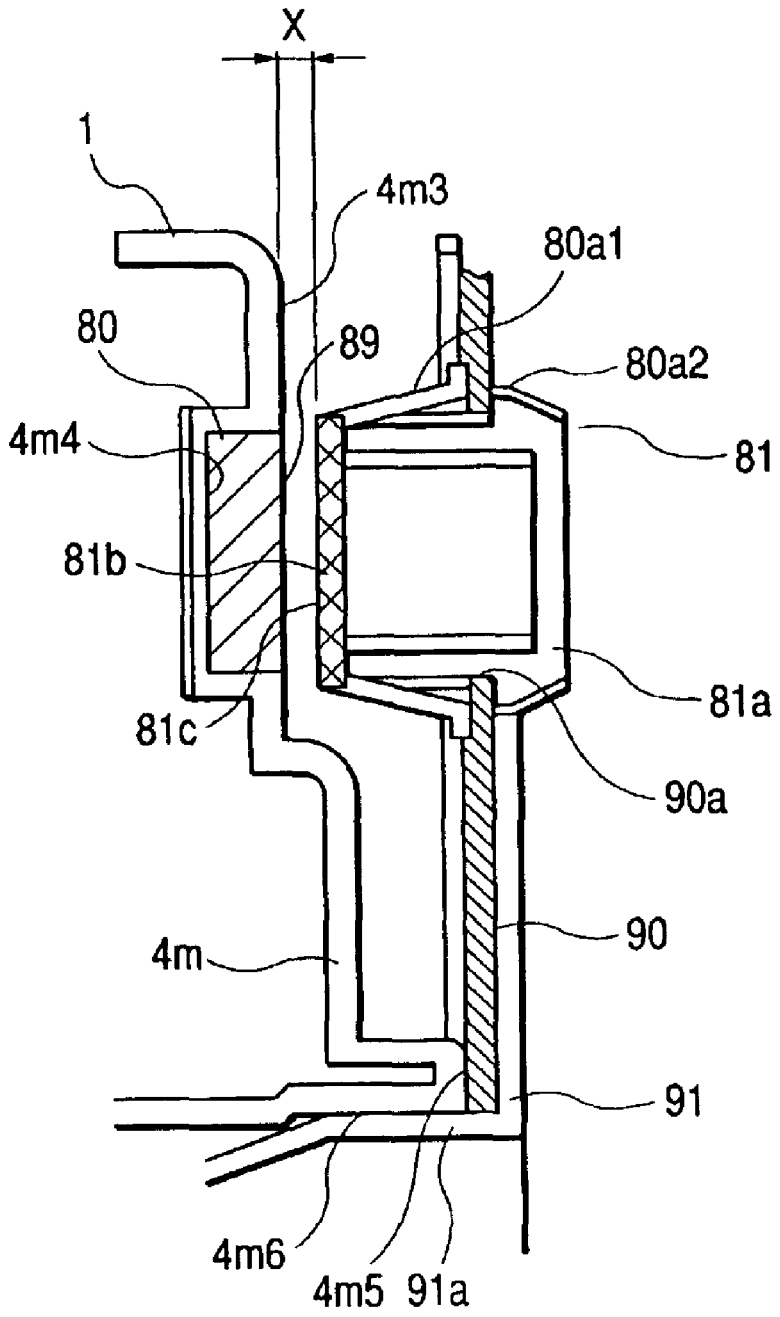
FIG. 8 is a sectional view showing the gap between a communication unit and a memory unit.

The embodiments of the invention will be now described with FIGS. 6, 7, and 8.

(Description of Memory System)

The memory system of the embodiment utilizes a method that employs a magnetic core as a communication antenna at the process cartridge 1 at a position where the main body of the image forming apparatus 100 contacts the process cartridge 1, and an inductor as a communication antenna provided on the main body of the image forming apparatus, so that information communication between the main body of the image forming apparatus 100 and the process cartridge 1 is performed by radio by means of electromagnetic induction of an inductor and induction via a magnetic core.

In FIGS. 6 and 7, a memory unit 80 is provided on the driving part side cover 4*m* of the process cartridge 1. And a communication unit 81 as communication means connected to a controller (not shown) is provided in the main body of the image forming apparatus 100. When the process cartridge 1 is mounted to the main body of the image forming apparatus 100, an antenna 80*f* (see FIGS. 9, 11, and 12) of the memory unit 80 faces the communication antenna 81*b* of the communication unit 81, and power is supplied to a memory 80*e* of the memory unit 80 and also the controller (not shown) of the main body of the apparatus 100 and the memory 80*e* can communicate with each other, allowing information to be read from/written to the memory 80*e*.

(Configuration and Mounting Configuration of Communication Unit)

Next, the configuration and mounting configuration of the communication unit 81 of the main body of the image forming apparatus 100 will be described.

As shown in FIG. 8, the communication antenna 81*b* is attached to a communication unit holding member 81*a*. The communication antenna 81*b* may be attached to the communication unit holding member 81 a using double-faced tape, adhesive, a snap fitting, heat caulking, ultrasonic welding, and the like. And the communication unit holding member 81*a* is inserted to a hole 90*a* of base sheet metal 90 of the main body driving unit. The communication unit holding member 81*a* has a hook shape 81*a*1 with its tip protruding upward and downward, and is fixedly supported by being hooked with the hook.

The hook shape 81*a*1 is pressed into the holding member 81*a* against resilience through the hole 90*a*, and it goes back outwardly as it passes the hole 90*a* and gets fixed to the base sheet metal 90 by pinching the base sheet metal 90 with the flange 81*a*2 of the holding member 81*a*. Therefore, since the facing plane 81*c* between the end surface of the flange 80*a*2 contacting the surface of the base sheet metal 90 of the communication unit 81 and the memory unit 80 is a certain size in the range of a manufacturing error, the facing plane 81*c* has a fixed protruding length from the base sheet metal 90.

(Configuration and Mounting Configuration of Memory Unit)

The configuration and mounting configuration of a memory unit will be described next.

Figure 9:
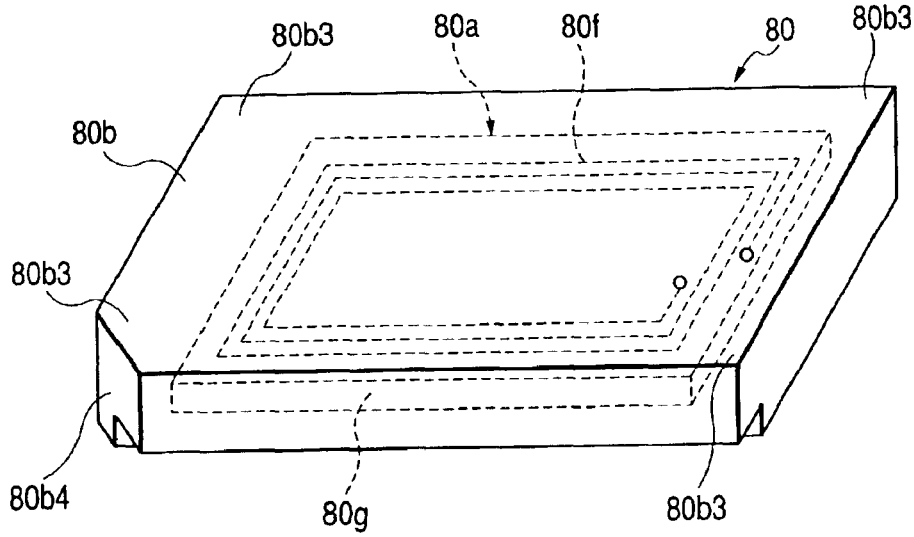
FIG. 9 is a perspective view of the memory unit.
Figure 10:
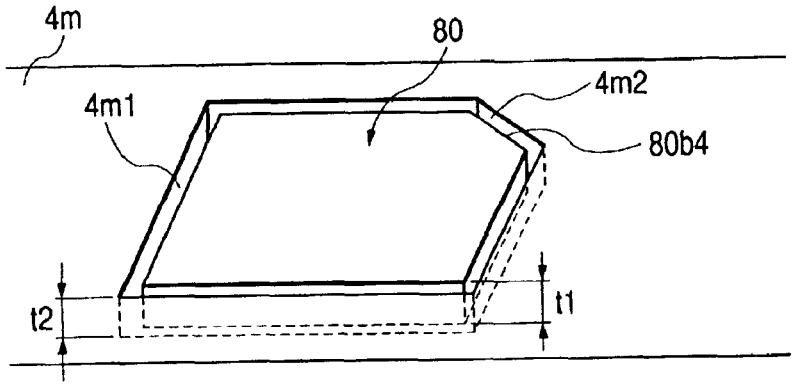
FIG. 10 is a perspective view showing the memory unit being mounted.
Figure 11:
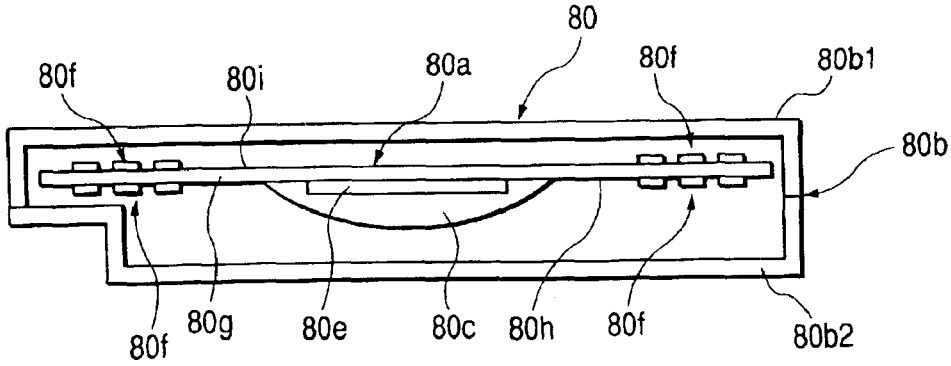
FIG. 11 is a longitudinal sectional view of the memory unit.
Figure 12:
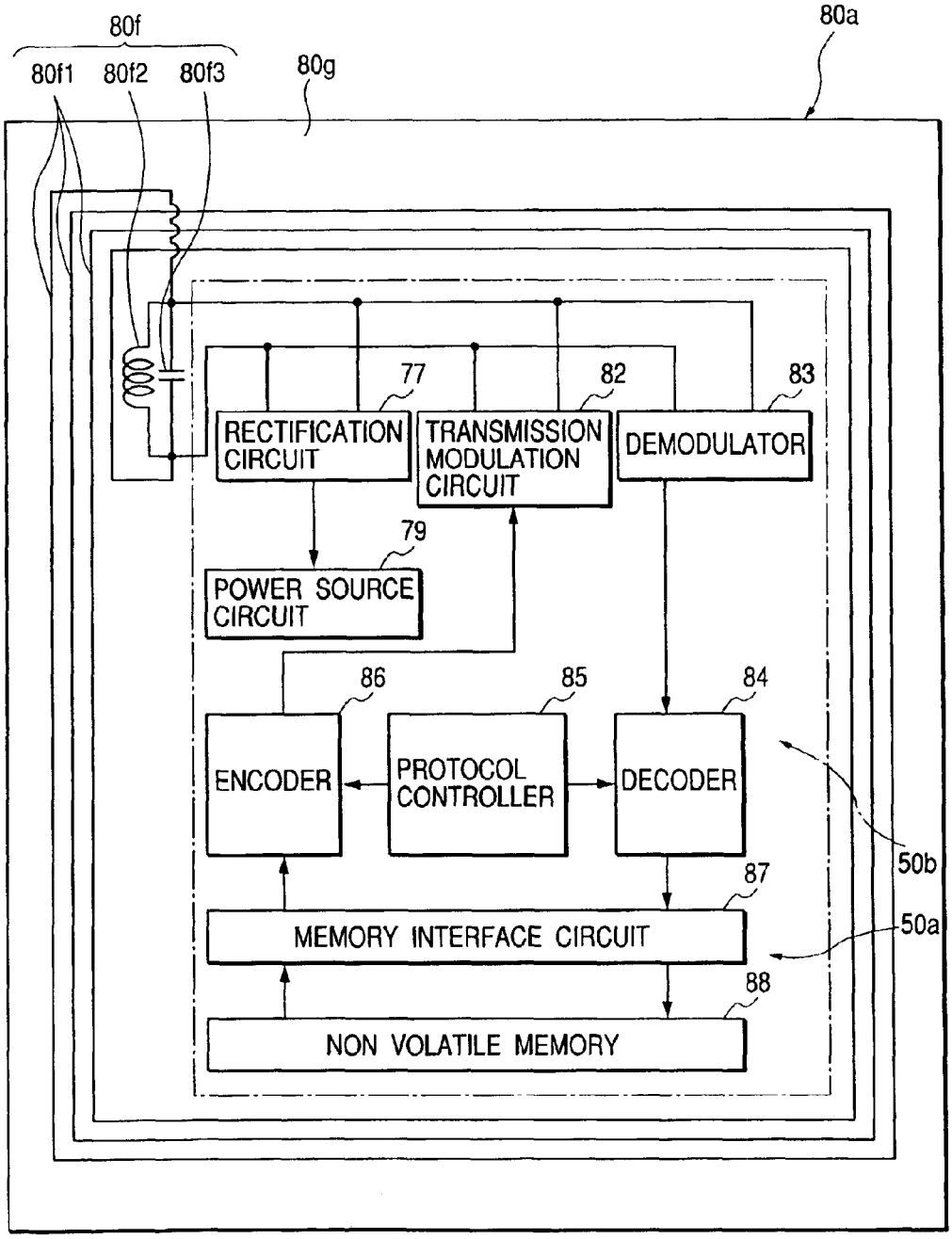
FIG. 12 is a front view of a base plate unit.

The configuration of the memory unit 80 will be described. As shown in FIGS. 9, 10, and 11, the memory unit 80 functioning as storage means has a card-like shape, consisting of a base plate unit (substrate unit) 80*a* and a protecting portion 80*b* functioning as an exterior member that covers the base plate unit 80*a*. The base plate unit 80*a* comprises the memory 80*e*, a storage portion 50*a*, and a communication portion 50*b*, as shown in FIG. 12. As shown in FIG. 11, the base plate unit 80*a* integrally incorporates the memory 80*e* for storing information, an antenna 80*f* for communication that is a magnetic core functioning as a memory antenna, and a base plate 80*g* functioning as a main board on which the memory 80*e* and the antenna 80*f* are mounted, into a unit. The memory 80*e* is provided on the rectangular base plate 80*g* made of epoxy resin. Specifically, the memory 80*e* is provided on the bottom side 80*h* of the base plate 80*g* (the opposite side of the side facing the communication antenna 81*b* provided on the main body of the apparatus 100), and is positioned to be surrounded by a continuity pattern 80*f*1 of the antenna 80*f* shown in FIG. 12. More specifically, the memory 80*e* is provided inside the pattern 80*f*1 almost at the center of the bottom side 80*h* of the base plate 80*g*. The memory 80*e* utilizes FERAM.

The memory 80*e* functioning as a storage portion is configured integrally with a transmission circuit constituting the communication portion 50*b* in FIG. 12. The antenna 80*f* is provided on the upper side 80*i* of the base plate 80*g* (on the side facing the communication antenna 81*b* provided on the main body of the apparatus 100). The antenna 80*f* has a pattern 80*f*1 of a spiral shape along the rectangular shape of the base plate 80*g*. The pattern 80*f*1 is formed on the base plate 80*g* with pattern printing. And the pattern 80*f*1 is connected to the memory 80*e* (FERAM). The base plate unit 80*a* thus configured is positioned inside the protecting portion 80*b* functioning as a frame member. The protecting portion 80*b* consists of an upper frame 80*b*1 functioning as an upper exterior portion and a bottom frame 80*b*2 functioning as a bottom exterior portion made of polystyrene resin.

The upper frame 80*b*1 and the bottom frame 80*b*2 are connected with adhesive, welding, or ultrasonic welding after the base plate unit 80*a* is inserted. The protecting portion 80*b* functioning as a frame member is made of a member having an induction rate of 2 to 5. Besides polystyrene resin, acrylnitrile butadiene resin and polycarbonate resin, for example, may be appropriately used for the material for the non-conductive member.

The internal configuration of the memory unit 80 will be described using FIG. 12.

FIG. 12 illustrates the circuitry of the memory unit 80. As shown in FIG. 12, the memory 80*e* is configured integrally with transmission circuitry provided on the base plate 80*g*. The transmission circuitry sends information stored in the memory 80*e* to the antenna 80*f*. The antenna 80*f* includes a coil 80*f*2, a capacitor 80*f*3, and a spiral continuity pattern 80*f*1. A rectification circuit 77 for the transmission circuitry, a transmission modulation circuit 82, and a demodulator 83 are connected to the antenna 80*f*. The output of the rectification circuit 77 is connected to a power source circuit 79, supplying power to non-volatile memory 88. The memory 80*e* consists of a decoder 84, a protocol controller 85, an encoder 86, a memory interface circuit 87, and the non-volatile memory 88, such as EEPROM or ferroelectric memory. After the demodulator 83 has demodulated a high frequency wave into a base band signal, the signal is converted to a signal appropriate for sending it to the non-volatile memory 88 by the decoder 84 under the control of the protocol controller 85. Then, the signal is divided into an address and data by the memory interface circuit 87, and an operation of reading to/writing from the non-volatile memory is carried out according to a read/write command. Data read from the non-volatile memory is sent through the memory interface circuit 87 to the encoder 86 to be converted to a protocol suitable for communication by the protocol controller 85 and sent from the transmission modulation circuit 82 to the antenna 80*f*.

According to the embodiment, practicality is attained if the distance between the communication antenna 81*b* and the antenna 80*f* can be maintained at 1 mm to 10 mm.

FIG. 11 will be further described.

As shown in FIG. 11, the memory unit 80 of the embodiment is provided with the continuity patterns 80*f*1 of the antenna 80*f* on the upper side 80*i* of the base plate 80*g* (the side facing the communication antenna 81*b* of the main body of the apparatus 100), and on the bottom side 80*h* of the opposite side of the upper side 80*i* (the opposite side of the side facing the communication antenna 81*b*, that is, the side on which memory 80*e* is provided). More particularly, the continuity pattern 80*f*1 of the antenna 80*f* is provided such that it passes on the upper side 80*i* of the base plate 80*g* and then goes through the base plate 80*g* to the bottom side 80*h* of the base plate 80*g*, then it passes on the bottom side 80*h* of the base plate 80*g* and again goes through the base plate 80*g* to the upper side 80*i* of the base plate 80*g*. Holes in the base plate 80*g* are not illustrated. The continuity pattern 80*f*1 provided on the upper side 80*i* and bottom side 80*h* of the base plate 80*g* is electrically connected through these holes at its one end and the other end. And this continuity pattern 80*f*1 is electrically connected to transmission circuitry as a part of memory 80*e*. The pattern 80*f*1 has a spiral shape in conformity with the rectangular shape of the base plate 80*g*. Memory 80*e* is covered with a bonding 80*c* made of resin provided on the base plate 80*g* for protection. This enables the memory 80*e* to be protected from external impact exerted on the memory 80*e* in the process of manufacturing the base plate unit 80*a*, or assembling the upper frame 80*b*1, the bottom frame 80*b*2 and the base plate unit 80*a* into a memory unit.

To ensure the reliability of the communication antenna 81*b* and the antenna 80*f*, it is necessary to regulate the top and bottom sides of the memory unit 80 opposing to the communication antenna 81*b*, or each opposing position of the memory.

The embodiment thus regulates the upper and bottom sides of the memory unit 80 that faces the communication antenna 81*b*, or the position where they face each other. That is, as shown in FIG. 9, to regulate the mounting direction of the memory unit 80 in mounting the unit 80, a chamfer 80*b*4 functioning as a regulating portion is provided on one of the multiple comers 80*b*3 on the periphery of the protecting portion 80*b* that is a frame member of the memory unit 80. The memory unit 80 is attached to the driving part side cover 4*m*. As shown in FIG. 10, a concave portion **4*m*1 for removably attaching the memory unit 80 is provided in the driving part side cover 4*m*. The concave portion 4*m*1 is provided at a position where the memory unit 80 faces the communication antenna 81*b* in the direction of inserting the process cartridge 1. That is, the concave portion 4*m*1 is provided at the end of the path the cartridge follows when the cartridge is attached to the main body of the apparatus 100 in the driving part side cover 4*m*. The concave portion 4*m*1 has a chamfer 4*m*2 functioning as a regulating portion for regulating the direction of attachment of the memory unit 80 and is positioned on one of the multiple corners on the inner periphery. In other words, the concave portion 4*m*1 has a shape almost the same as the plane shape of the memory unit 80. The chamfer 4*m*2 provided in the concave portion 4*m*1 has a shape that fits the chamfer 80*b*4 provided on one of the corners of memory unit 80**.

When the memory unit 80 is mounted to the concave portion **4*m*1, the memory unit 80 is fit into the concave portion 4*m*1 in the attachment direction of the memory unit 80 with the chamfer 80*b*4 and the chamfer 4*m*2 aligned. This enables the regulation of the upper and bottom sides of the memory unit 80 to the communication antenna 81*b* or the facing position. It can also prevent the memory unit 80 from being attached upside down. And a mistake in the direction in which the memory element 80 is mounted can be avoided. The depth t2 of the concave portion 4*m*1 is the thickness t1 of the memory unit 80**.

The driving part side cover **4*m* is an integral molding made of a synthetic resin, and the longitudinal distance between the bottom 4*m*4 of the concave portion 4*m*1 and the pressing portion 4*m*5 where the driving part side cover 4*m* is pressed against the base sheet metal 90 is controlled so as to reduce the manufacturing error. The bottom 4*m*4 of the concave portion 4*m*1 and the end surface of the pressing portion 4*m*5 are parallel, and the bottom 4*m*4 of the concave portion 4*m*1 and the plane of the base sheet metal 90 are parallel. In some embodiments, the end surface of the pressing portion 4*m*5 and the outer surface 89 of the memory unit 80** may be in a common plane.

As has been described, the driving part side cover **4*m* is a positioning member for the process cartridge 1 relative to the main body of the apparatus 100 in the longitudinal direction and also is a positioning member for the memory unit functioning as storage means relative to the main body of the apparatus 100**.

As shown in FIG. 6, the memory unit 80 is attached to the driving part side cover **4*m*. It may be attached with double-faced tape, adhesive, a snap fit, heat caulking, ultrasonic welding and the like. And the memory unit 80 of course has sufficient strength to prevent detachment due to vibration when a user touches the unit, or attaches a process cartridge 1 to the image forming apparatus 100 and closes the centering plate 59 shown in FIG. 3**.

The process cartridge 1 has the driving part side cover **4*m* and non-driving part side cover 4*n* fixed at the both ends of the longitudinal direction of the frame body proper 4*p*** that is longitudinally long.

(Securement of a Gap Between a Memory Unit and a Communication Unit)

In the following, a gap X between the memory unit 80 and the communication unit 81 will be described.

The gap X refers to the distance between the outer surface 89 of the memory unit 80 and the facing plane **81*c* of the communication antenna that faces the outer surface 89** in parallel.

As shown in FIG. 7, the process cartridge 1 attached with the memory unit 80 is configured in such a way that, when the cartridge 1 is mounted to the main body of the image forming device 100, the pushed portion **4*n*1 of the non-driving part side cover 4*n* is pushed by the energizing or biasing spring 71 coupled to the front door 58 to press the pressing portion 4*m*5 arranged at an outer end portion of a hole portion 4*m*6 in the driving part side cover 4*m* against the base sheet metal 90 of the main body driving unit so that the position in the longitudinal direction is regulated. The energizing spring 71 of the embodiment generates a spring force of about 500 gf to 1500 gf when the front door 58 is closed. The driving part side cover 4*m* is molded with resin, allowing part accuracy to be created. Thus, the memory unit 80 can be accurately fixed so that the outer surface 89 of the memory unit 80 and the outer surface 4*m*3 of the driving part side cover 4*m* (see FIG. 8) will be a common plane. The communication unit 81 is also fixed directly to the base sheet metal 90 of the main body driving unit. Accordingly, by pressing the driving part side cover 4*m* against the base sheet metal 90, the accumulation of each part's tolerance can be minimized. Thus, the gap X between the memory unit 80 and the communication unit 81 can be accurately maintained as means for canceling the accumulation of part tolerances, without, for example, the need for the communication unit 81 to be movable. Here, the gap X represents the distance between the outer surface 89 of the memory unit 80 and the communication antenna side facing plane 81*c* that faces the outer surface 89**. Although the embodiment has addressed the process cartridge, the invention may be applied to each unit such as a development cartridge which incorporates a developer container containing developer and a developing member as a unitary cartridge which can be detachably mounted to the main body of the apparatus, or a toner cartridge.

Also, in the embodiment, the hole portion **4*m*6 (cylindrical member) is provided on the driving part side cover 4*m* (cover member) that fits the supporting pin 63 (main body supporting member) provided in the apparatus main body 100 so that the process cartridge 1 is positioned relative to the apparatus main body 100 in the direction which intersects the direction of mounting the process cartridge 1. And the pressing portion 4*m*5 (unit pressing portion) is provided in the hole portion 4*m*6** (cylindrical member) at its end in terms of the mounting direction.

Thus, positioning in the direction in which the process cartridge 1 is mounted and the direction which intersects the mounting direction can be made with the hole portion **4*m*6 (cylindrical member). This means that the process cartridge 1 can be smaller. In addition, since the pressing portion 4*m*5 (unit pressing portion) as a positioning portion for the mounting direction is cylindrical, the distance over which the base sheet metal 90 (main body base member) contacts the pressing portion 4*m*5 can be made long, positioning the process cartridge 1** stably without causing it to wobble.

The process cartridge, the development cartridge, and the toner cartridge are now summarized below.

The process cartridge is a process cartridge 1 that can be detachably mounted to the main body of an image forming apparatus 100 and includes an electrophotographic photosensitive drum 2, process means that acts on the electrophotographic photosensitive drum 2, and a memory element 88 that has a communication antenna **80*f* and communication means 50*b*, and has a memory unit 80 functioning as storage means that can communicate with a communication unit 81 functioning as communication means, which is fixedly disposed in the main body of the image forming apparatus 100** without contacting the memory unit 80, and a positioning member **4*m*5 that has a contacting plane that is biased toward the main body of the image forming apparatus 100 by an energizing spring 71 to contact the base sheet metal 90 of the main body of the image forming apparatus 100 and positioned in the direction opposite to the direction of the communication unit 81 fixedly placed on the image forming apparatus 100, wherein the storage means 80 is on a common or parallel plane integrally formed with the contacting surface of the positioning member 4*m*5**.

The development cartridge is a development cartridge 4 that can be detachably mounted to the main body of the image forming apparatus 100, comprising a developing sleeve **4*a* that is a developing member for developing an electrostatic latent image formed on the electrophotographic photosensitive drum 2**;

a developer container **4*h* for containing developer to be supplied to the developing member; and a memory element 88 that has a communication antenna 80*f* and a communication means 50*b*,** and has a memory unit 80 that functions as storage means that can communicate with the communication unit 81 functioning as communication means which is fixedly disposed in the main body of the image forming apparatus 100 without contacting the memory unit 80, and a positioning member that has a contacting plane which is biased toward the main body of the image forming apparatus 100 to contact the main body and is positioned in the direction opposite to the direction of the communication means fixedly disposed in the main body of the image forming apparatus, wherein the storage means is on a common or parallel plane integrally formed with the contacting plane of the positioning member.

The toner cartridge is a toner replenishment container 5 as a toner cartridge that can be detachably mounted to the main body of the image forming apparatus 100, including a container proper **5*g* for containing developer to be supplied to a developing device 4 provided in the main body of the image forming apparatus 100 and having an discharge opening 5*f* for discharging the developer to the developing device 4, a screw 5*a*, an agitating plate 5*b*, and an agitating axis 5*c* as carrying members that agitate the developer in the container proper and carry it toward the discharge opening, and a memory element 88 that has a communication antenna 80*f* and a communication means 50*b*,** and has a memory unit 80 functioning as storage means that can communicate with a communication unit 81 as communication means fixedly disposed in the main body of the image forming apparatus 100 in a non-contacting manner, and a positioning member that has a contacting plane that is biased toward the main body of the image forming apparatus 100 to contact the main body and is positioned in the direction opposite to the direction of the communication means fixedly disposed in the main body of the image forming apparatus 100, wherein the storage means 80 is on a common or parallel plane integrally formed with the contacting plane of the positioning member.

As has been described, according to the invention, the communication between the communication means provided in the electrophotographic image forming apparatus and the storage means can be ensured.

It is also possible to maintain a fixed distance between the communication means provided in the electrophotographic image forming apparatus and the storage means.

And it is also possible to simplify the configurations of the communication means provided in the electrophotographic image forming apparatus and storage means.

What is claimed is:

1. A unit that can be detachably mounted to an electrophotographic image forming apparatus main body having a fixed main body base member and communication means provided in the main body base member, comprising:

a cover member;

a unit abutting portion provided on said cover member and abutting against the main body base member, configured and positioned to position said unit to said apparatus main body when said unit is being mounted to the apparatus main body; and a memory element provided on said cover member, and disposed at a position facing the communication means, and configured and positioned to communicate with the communication means without contacting the communication means, wherein said unit abutting portion is provided at a top end of said unit in a mounting direction in which said unit is mounted onto the apparatus main body, and wherein said unit is positioned in the mounting direction with respect to the apparatus main body by said unit abutting portion abutting against the main body base member.

2. A unit according to claim 1, wherein said unit abutting portion is provided integrally with said cover member, and said memory element is provided on a common or a parallel plane with said unit abutting portion.

3. A unit according to claim 1, further comprising a cylindrical member provided on said cover member configured and positioned to fit with a main body supporting member provided in the apparatus main body to position said unit to the apparatus main body in a direction intersecting the mounting direction, and wherein said unit abutting portion is provided at a top end of said cylindrical member in the mounting direction.

4. A unit according to claim 1, further comprising:

another cover member provided on an opposite side to said cover member along a longitudinal direction of said unit; and a pushed portion provided on said another cover member and pushed by an energizing member provided on the electrophotographic image forming apparatus main body, wherein said pushed portion is configured and positioned to receive a pushing force along a direction in which said unit abutting portion abuts onto the main body base member.

5. A process cartridge that can be detachably mounted to an electrophotographic image forming apparatus main body having a fixed main body base member and communication means provided in the main body base member, comprising:

an electrophotographic photosensitive member;

process means for acting on said electrophotographic photosensitive member;

a cover member;

a process cartridge abutting portion provided on said cover member and abutting against the main body base member, configured and positioned to position said process cartridge to the apparatus main body when said process cartridge is mounted to the apparatus main body; and a memory element provided on said cover member, disposed at a position facing the communication means, and configured and positioned to communicate with the communication means without contacting the communication means, wherein said process cartridge abutting portion is provided at a top end of said process cartridge in a mounting direction in which said process cartridge is mounted onto the apparatus main body, and said process cartridge is positioned in the mounting direction with respect to the apparatus main body by said process cartridge abutting portion abutting against the main body base member.

6. A process cartridge according to claim 5, wherein said process cartridge abutting portion is provided integrally with said cover member, and said memory element is provided on a common or parallel plane with said process cartridge abutting portion.

7. A process cartridge according to claim 5, further comprising a cylindrical member provided on said cover member, configured and positioned to fit with a main body supporting member provided in the apparatus main body to position said process cartridge to the apparatus main body in a direction intersecting the mounting direction, and wherein said process cartridge abutting portion is provided at a top end of said cylindrical member in the mounting direction.

8. A process cartridge according to claim 5, further comprising:

another cover member provided on an opposite side to said cover member along a longitudinal direction of said process cartridge; and a pushed portion provided on said another cover member and pushed by an energizing member provided on the electrophotographic image forming apparatus main body, configured and positioned to receive a pushing force along a direction in which said process cartridge abutting portion abuts onto the main body base member.

9. A development cartridge that can be detachably mounted to an electrophotographic image forming apparatus main body having a fixed main body base member and communication means provided on the main body base member, comprising:

a developing member configured and positioned to develop an electrostatic latent image formed on an electrophotographic photosensitive member;

a toner container configured to contain toner to be supplied to said developing member;

a cover member;

a development cartridge abutting portion provided on said cover member and abutting against the main body base member, configured and positioned to position said development cartridge to the apparatus main body when said development cartridge is mounted to the apparatus main body; and a memory element provided on said cover member, disposed at a position facing the communication means, and configured and positioned to communicate with the communication means without contacting the communication means, wherein said development cartridge abutting portion is provided at a top end of said development cartridge in a mounting direction in which said development cartridge is mounted onto the apparatus main body, and wherein said development cartridge is positioned in the mounting direction to the apparatus main body by said development cartridge abutting portion abutting against the main body base member.

10. A development cartridge according to claim 9, wherein said development cartridge abutting portion is provided integrally with said cover member, and said memory element is provided on a common or parallel plane with said development cartridge abutting portion.

11. A development cartridge according to claim 9, further comprising a cylindrical member that is provided on said cover member and fits with a main body supporting member provided in the apparatus main body to position said development cartridge to the apparatus main body in a direction intersecting the mounting direction, and wherein said development cartridge abutting portion is provided at the top end of said development cartridge in a direction in which said cylindrical member is mounted.

12. A development cartridge according to claim 9, further comprising:

another cover member provided on an opposite side to said cover member along a longitudinal direction of said development cartridge; and a pushed portion provided on said another cover member and pushed by an energizing member provided on the electrophotographic image forming apparatus main body, configured and positioned to receive a pushing force along a direction in which said development cartridge abutting portion abuts onto the main body base member.

13. A toner cartridge that can be detachably mounted to an electrophotographic image forming apparatus main body having a fixed main body base member and communication means provided in the main body base member, comprising:

a toner container that contains toner to be supplied to a developing apparatus provided in the apparatus main body and has a toner supplying opening configured and positioned to supply the toner to the developing apparatus;

a carrying member configured and positioned to agitate the toner in said toner container and to carry the toner to the toner supplying opening;

a cover member;

a toner cartridge abutting portion, provided on said cover member and abutting against the main body base member, configured and positioned to position said toner cartridge to the apparatus main body when said toner cartridge is mounted to the apparatus main body; and a memory element that is provided on said cover member, disposed at a position facing the communication means, and configured and positioned to communicate with the communication means without contacting the communication means, wherein said toner cartridge abutting portion is provided at a top end of said toner cartridge in a direction in which said toner cartridge is mounted onto the apparatus main body, and wherein said toner cartridge is positioned in the mounting direction to the apparatus main body by said toner cartridge abutting portion abutting against the main body base member.

14. A toner cartridge according to claim 13, wherein said toner cartridge abutting portion is provided integrally with said cover member, and said memory element is provided on a common or parallel plane with said toner cartridge abutting portion.

15. A toner cartridge according to claim 13, further comprising a cylindrical member provided on said cover member that fits with a main body supporting member provided in the apparatus main body to position said toner cartridge to the apparatus main body in a direction intersecting the mounting direction, wherein said toner cartridge abutting portion is provided at a top end of said cylindrical member in the mounting direction.

16. A toner cartridge according to claim 13, further comprising:

another cover member provided on an opposite side to said cover member along a longitudinal direction of said toner cartridge; and a pushed portion provided on said another cover member and pushed by an energizing member provided on the electrophotographic image forming apparatus main body, configured and positioned to receive a pushing force along a direction in which said toner cartridge abutting portion abuts onto the main body base member.

17. An electrophotographic image forming apparatus having an electrophotographic image forming apparatus main body and to which a unit can be detachably mounted, for forming an image on a recording medium, comprising:

(i) a fixed main body base member;

(ii) communication means for communicating with a memory element of the unit without contacting the memory element and provided on said main body base member;

(iii) mounting means for mounting the unit, the unit having a cover member, a unit abutting portion that is provided on the cover member and abutting against said main body base member, configured and positioned to position the unit to said electrophotographic image forming apparatus main body when the unit is mounted onto said electrophotographic image forming apparatus main body, and the memory element provided on the cover member and disposed at a position facing said communication means, capable of communicating with said communication means without contacting said communication means, wherein the unit abutting portion is provided at a top end of the unit in a mounting direction in which the unit is mounted onto the apparatus main body, and wherein the unit is positioned in the mounting direction with respect to the apparatus main body by the unit abutting portion abutting against said main body base member; and (iv) conveying means for conveying the recording medium.

18. An electrophotographic image forming apparatus according to claim 17, further comprising biasing means for pushing the unit in a direction the unit abutting portion abuts against said main body base member.

19. An electrophotographic image forming apparatus having an apparatus main body and to which a process cartridge can be detachably mounted, for forming an image on a recording medium, having:

(i) a main body base member;

(ii) communication means fixedly provided on said main body base member for communicating with a memory element of the process cartridge without contacting the memory element;

(iii) mounting means for detachably mounting the process cartridge having an electrophotographic photosensitive member, process means for affecting the electrophotographic photosensitive member, a cover member, a process cartridge abutting portion provided integrally with the cover member and abutting against said main body base member when the process cartridge is mounted to said apparatus main body, configured and positioned to position the process cartridge to said apparatus main body when the process cartridge is mounted onto said apparatus main body, a pushed portion that is pushed in a direction in which the process cartridge abutting portion abuts against said main body base member, and the memory element fixedly disposed at a position on the cover member that faces said communication means, capable of communicating with said communication means without contacting said communication means; and (iv) conveying means for conveying the recording medium.

20. An electrophotographic image forming apparatus according to claim 19, further comprising biasing means for pushing the process cartridge in a direction the process cartridge abutting portion abuts against said main body base member.

21. An electrophotographic image forming apparatus having a main body and to which a toner cartridge can be detachably mounted, for forming an image on a recording medium, comprising:

(i) a main body base member;

(ii) communication means fixedly provided on said main body base member for communicating with a memory element of the toner cartridge without contacting the memory element;

(iii) mounting means for detachably mounting the toner cartridge, the toner cartridge having a toner container configured to contain toner to be supplied to a developing apparatus provided in said main body of said apparatus and having a toner supplying opening configured and positioned to supply the toner to the developing apparatus, a carrying member that agitates the toner in the toner container and carries the toner to the toner supplying opening, a cover member, a toner cartridge abutting portion, provided on the cover member and abutting against said main body base member, configured and positioned to position the toner cartridge to said main body of said electrophotographic image forming apparatus when the toner cartridge is mounted onto said main body, and the memory element provided on the cover member and disposed at a position facing said communication means, capable of communicating with said communication means without contacting said communication means, wherein the toner cartridge abutting portion is provided at a top end of the toner cartridge in a direction in which the toner cartridge is mounted onto the apparatus main body, and wherein the toner cartridge is positioned in the mounting direction to the apparatus main body by the toner cartridge abutting portion abutting against said main body base member; and (iv) conveying means for conveying the recording medium.

22. An electrophotographic image forming apparatus according to claim 19, further comprising biasing means for pushing the toner cartridge in a direction the toner cartridge abutting portion abuts against said main body base member.

* * * * *

UNITED STATES PATENT AND TRADEMARK OFFICE

CERTIFICATE OF CORRECTION

PATENT NO. : 6,912,365 B2
DATED : June 28, 2005
INVENTOR(S) : Takahito Ueno et al.

It is certified that error appears in the above-identified patent and that said Letters Patent is hereby corrected as shown below:

Column 1,
Line 38, “mounted” should read -- mounted to --.

Column 2,
Line 30, “An another” should read -- Another --.

Column 4,
Line 59, “disposed” should read -- disposed at --.

Column 7,
Line 23, “SnO2” should read -- $S_nO_2$ --.

Column 8,
Line 30, “users” should read -- users’ --.

Column 9,
Line 44, “laser” should read -- laser light --.

Column 10,
Line 35, “be now” should read -- now be --.

Column 11,
Line 28, “arc rotatably” should read -- are rotatably --.

Column 13,
Line 19, “font door” should read -- front door --.
Line 41, “also” should read -- are also --.

Column 14,
Line 3, “frame 1 a” should read -- frame 1a --.
Line 23, “be now” should read -- now be --.
Line 57, “member 81 a” should read -- member 81a --.

Column 16,
Line 65, “comers” should read -- corners --.

Column 19,
Line 38, “an discharge” should read -- a discharge --.

UNITED STATES PATENT AND TRADEMARK OFFICE

CERTIFICATE OF CORRECTION

PATENT NO. : 6,912,365 B2
DATED : June 28, 2005
INVENTOR(S) : Takahito Ueno et al.

It is certified that error appears in the above-identified patent and that said Letters Patent is hereby corrected as shown below:

Column 23,
Line 44, “direction” should read -- direction in which --.

Column 24,
Lines 16 and 58, “direction” should read -- direction in which --.
Line 57, “claim 19,” should read -- claim 21, --.

Signed and Sealed this

Seventh Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,912,365 B2
APPLICATION NO. : 10/237783
DATED : June 28, 2005
INVENTOR(S) : Ueno et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 155 days.

Signed and Sealed this
Twenty-sixth Day of July, 2011

David J. Kappos

David J. Kappos
*Director of the United States Patent and Trademark Office*